United States Patent [19]

Ghebresillassie

[11] 4,278,172

[45] Jul. 14, 1981

[54] THERMOS JAR CARRIER & LUNCH TRAY

[76] Inventor: Francesco Ghebresillassie, 3739 Portal Ave., Temple Hills, Md. 20031

[21] Appl. No.: 98,787

[22] Filed: Nov. 30, 1979

[51] Int. Cl.[3] ..... A45C 11/20

[52] U.S. Cl. ..... 206/544; 206/546; 206/549; 220/94 A

[58] Field of Search ..... 206/541, 543, 544, 546, 206/547, 549; 220/94 A

[56] References Cited

U.S. PATENT DOCUMENTS

| | | | |
|---|---|---|---|
| 265,796 | 10/1882 | Gernand | 206/546 |
| 1,458,679 | 6/1923 | Bishop | 206/541 |
| 2,763,366 | 9/1956 | Smith et al. | 206/544 |
| 3,097,782 | 7/1963 | Koropatkin et al. | 206/549 |
| 3,372,690 | 3/1968 | Ruiz | 206/544 |

FOREIGN PATENT DOCUMENTS

| | | | |
|---|---|---|---|
| 2410944 | 9/1974 | Fed. Rep. of Germany | 206/549 |
| 938389 | 5/1964 | United Kingdom | 206/541 |

*Primary Examiner*—Joseph Man-Fu Moy

[57] ABSTRACT

A thermos jar carrier and lunch tray, one unit functioning as two different units; when closed it is a thermos jar carrier; when open it is a ready made lunch tray. The carrier is formed from a box like structure. The four individual sides are hinged together to form the housing unit (or carrier). When the unit is closed the protruding lips; (extending outward from the lower and upper portion of each individual side forming the housing unit), prevent the thermos jar from escaping from the housing unit, thus acting as retainers, keeping the thermos jars in place within the housing unit.

The housing unit when in its open position, the sides form into a lunch tray with individual compartments, whereby thermos jars, cup or cups, utensils and other miscellaneous items relating to the consumption of the food product can be placed in these individual compartments and use them with a degree of stability.

3 Claims, 5 Drawing Figures

THERMOS JAR CARRIER & LUNCH TRAY

SUMMARY OF THE INVENTION

It is cheap to manufacture, simple in construction and highly efficient. It is unique and sanitary, possesses a marked degree of utility.

Accordingly this invention consists essentially in providing a carrier (depending in size of units), for three or more small thermos jars; such as those used for containing fruits, meats, soups, hot or cold liquids or other perishable articles, which upon opening the carrier it becomes a ready made lunch tray. Thus the thermos jars could be placed in their respective individual compartments on the tray and use it with a degree of stability.

Therefore it functions as two units in one. When closed is a carrier, when opened is a tray.

BRIEF DESCRIPTION OF THE DRAWING

Further objects and advantages of this invention will become more apparent from the following specifications and claims, and from the accompanying drawings wherein:

DETAILED DESCRIPTION OF THE PREFERRED EMBODIMENT

Figure 1:
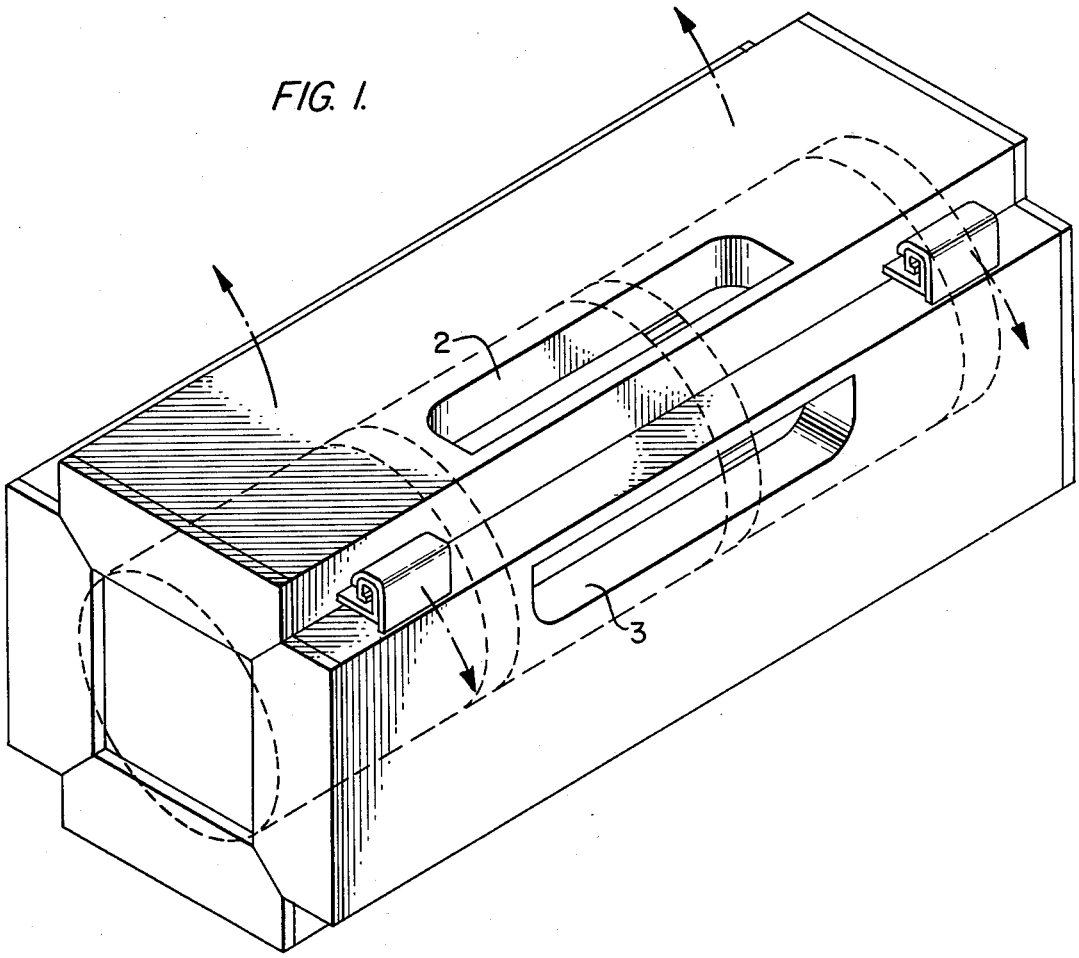
FIG. 1. Is a front view in elevation of the thermos jar carrier and lunch tray, in the closed position.
Figure 5:
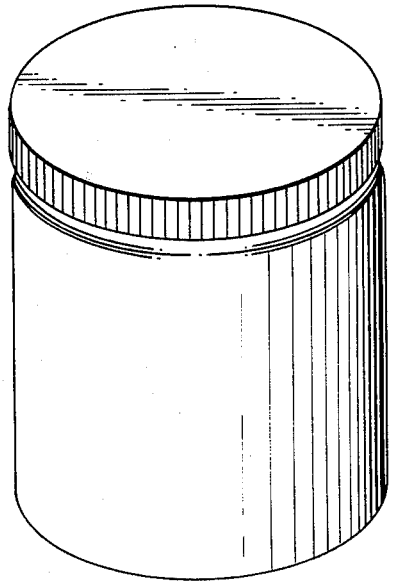
FIG. 5. Is a front view of a thermos jar.

Referring now to the drawings in detail, wherein like numerals indicate like elements throughout the several views. The Thermos Jar Carrier and Lunch Tray as shown:

FIG. 1. Shows unit in the closed position and also thermos jars within the housing unit. 2 & 3 represents handles. 12, shows clamps holding carrying housing unit closed.

Figure 2:
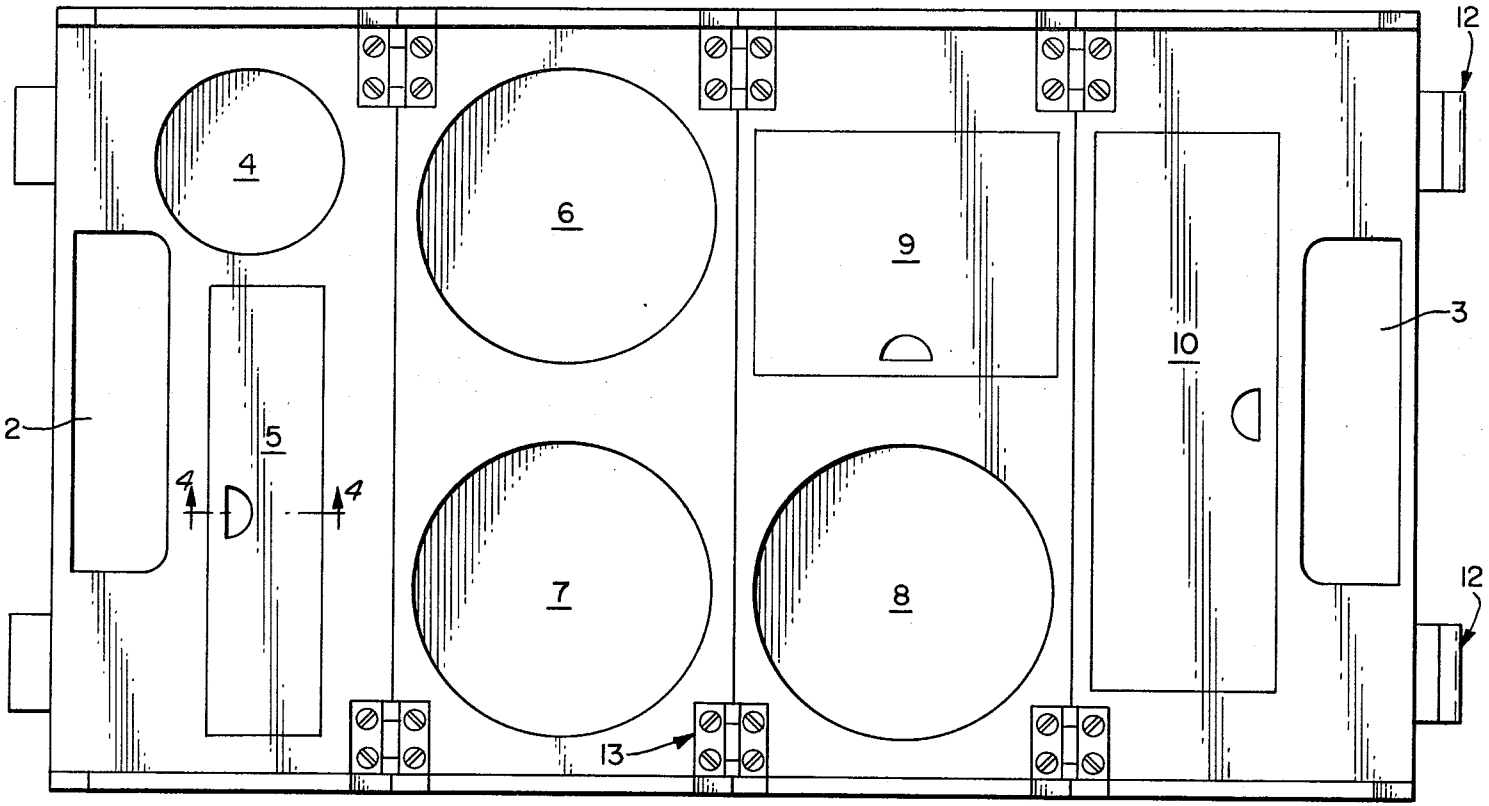
FIG. 2. Is the cross-sectional view of each individual tray side of the carrier.

FIG. 2. The housing unit is open ready to be used as a tray. 2 & 3, are the carrying handles. 4, collapsable cup or regular cup recessed retainer. 5, covered recessed utensils compartment, its cover holding knife, spoons and forks in place when housing unit is closed. 6, 7, 8, thermos jars recessed compartments, wherein the thermos jars are placed when ready to be used. 9, recessed covered compartment for bread, sandwich or crackers, whose cover holds items in place when housing unit is closed. 10, covered recessed miscellaneous compartment whose cover holds items in place, when housing unit is closed. 12, clamps to keep housing unit closed. 13, hinghes holding sides of housing unit together.

Figure 3:
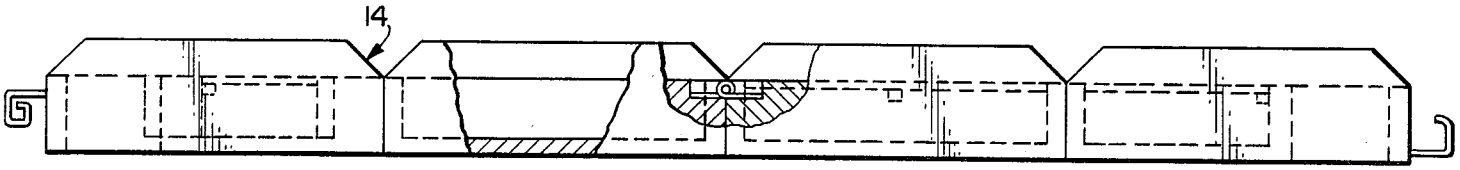
FIG. 3. Is the view of the tray as each side is laying side by side thus forming a ready made tray and within each tray, its separate recessed compartments.

In FIG. 3. We have the cross-sectional view of the tray. 14, each tray section has a lip at both ends, when housing unit is closed they act as thermos jar retainers, thus keeping jars from escaping through the housing unit. Each side of each lip has a 45 degree angle.

Figure 4:
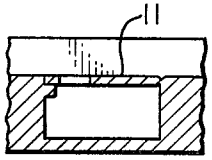
FIG. 4. Shows one of the compartment with a cover on (compartments 5, 9, 10 of FIG. 2 have covers to retain items in the compartments when the carrier is closed).

In FIG. 4. We have one of those covered recessed compartments with the lid on. Compartments as shown in FIG. 2, unit 5, 9, 10.

While I describe one specific form of (A carrying Thermos-Jar and Lunch-Tray) carrying my invention into effect. I do not desire to limit myself to such specific construction as the same may be modified to some extent and I wish to be understood and limiting myself to such specific construction.

What is claimed is as follows:

1. A thermos jar carrier and lunch tray comprising: at least of 3 tray portions, each portion having opposite sides of substantially the same height, a bottom wall and a top wall, each tray portion physically connected to each other in a row tray portion, said top wall including recesses for receiving a sandwich, utensils and like articles; each tray portions further including opposite upstanding end walls having a height greater than said side walls, said end walls including chamfered portions at each end of said end walls whereby when said tray portions being folded into an enclosure a space being formed among said tray portions for receiving a thermos jar, the carrier further including integral handles located on the bottom walls of said tray portions and a locking assembly of conventional nature to secure said tray portions shut when said tray portions are folded into an enclosure, each tray portions when in an open position forms a lunch tray.

2. A thermos jar carrier of claim 1, said handles are cut outs of a portion of said bottom walls.

3. A thermos jar carrier and lunch tray of claim 1, further said tray portions wherein a plurality of separate independent recesses means, are provided internally within some said recesses of said tray portions, a cover lids having its peripheral portions resting upon said sides and its edges abutting the side walls of said recesses forming a seal with the side walls of the recesses, said lid is drawn downwardly into sealing engagement with the top of said recesses to seal apart said sandwiches and utensils compartments.

* * * * *